US007861338B2

(12) United States Patent
Lee

(10) Patent No.: US 7,861,338 B2
(45) Date of Patent: Jan. 4, 2011

(54) PORTABLE AND FOLDABLE BED

(76) Inventor: HongWoo Lee, 29-910 Shindonga Apt., Banghak-3Dong, Tobong-ku, Seoul (KR)

( * ) Notice: Subject to any disclaimer, the term of this patent is extended or adjusted under 35 U.S.C. 154(b) by 74 days.

(21) Appl. No.: 12/078,966

(22) Filed: Apr. 8, 2008

(65) Prior Publication Data

US 2009/0249545 A1 Oct. 8, 2009

(51) Int. Cl.
*A47C 19/12* (2006.01)

(52) U.S. Cl. ..... 5/176.1; 5/111; 5/620

(58) Field of Classification Search ..... 5/174, 5/111, 110, 176.1, 200.1, 203, 207, 259.1, 5/262, 301, 304, 35, 620; 403/205, 217, 403/335–337; 108/166, 167, 170, 171, 175; 211/195, 28, 85, 119.006; 297/158.4
See application file for complete search history.

(56) References Cited

U.S. PATENT DOCUMENTS 1,670,055 A * 5/1928 Trimble ..... 5/264.1
2,452,645 A * 11/1948 Firsel ..... 5/207
4,092,748 A * 6/1978 Ewers ..... 5/85.1
4,616,950 A * 10/1986 Morris ..... 403/231
6,009,575 A * 1/2000 Hsieh ..... 5/174
6,035,467 A * 3/2000 Lee ..... 5/174
6,076,210 A * 6/2000 Wu ..... 5/618
2002/0144350 A1 * 10/2002 Shih ..... 5/620

* cited by examiner

*Primary Examiner*—Robert G Santos
*Assistant Examiner*—Nicholas Polito
(74) *Attorney, Agent, or Firm*—Robert E. Bushnell, Esq.

(57) ABSTRACT

A portable and foldable bed is disclosed, in which a support strength of a rotation support leg is enhanced by installing a triangle support plate at an engaged portion between a rotation pole of a rotation support leg and a connection bar, and a fixing plate with a width twice the width of a bed frame is provided in a bed frame engagement unit of a fixing support leg, and a closer contact unit is provided between the fixing plate and the fixing support leg for thereby obtaining a stable engagement of the same, and a foldable spring is disposed between a lower horizontal bar of a center support par and an outer frame of a bed frame, so a folding operation can be easily performed during a folding operation of a bed.

5 Claims, 7 Drawing Sheets

PORTABLE AND FOLDABLE BED

TECHNICAL FIELD

The present invention relates to a portable and foldable bed, and in particular to a portable and foldable bed in which a support strength of a rotation support leg is reliably enhanced by installing a triangle support plate at an engaged portion between a rotation pole of a rotation support leg and a connection bar, and a fixing plate with a width twice the width of a bed frame is provided in a bed frame engagement unit of a fixing support leg, and a closer contact unit is provided between the fixing plate and the fixing support leg for thereby obtaining a stable engagement of the same, and a foldable spring is disposed between a lower horizontal bar of a center support par and an outer frame of a bed frame, so a folding operation can be easily performed during a folding operation of a bed.

BACKGROUND ART

Generally, a portable and foldable bed is designed so that it can be folded at its center portion. So, the bed can be portable and be easily movable.

As shown in FIG. 1, the conventional portable and foldable bed comprises a bed frame 120 and a backrest frame 130 which are foldable from both sides with respect to a center support bar 110 which is formed by bending a rod in a rectangular shape, a bed unit 210 which is engaged to an upper side of the bed frame 120, a backrest unit 220 which is installed on an upper side 510 of the backrest frame 130, a rotation support leg 140 which is rotatably engaged to the bed frame 120, and a fixing support leg 150 which is engaged to an outer side of an outer frame member of the backrest frame 130.

Here, the rotation support leg 140 includes two rotation poles 141 which are engaged to a side frame member of the bed frame 120, a wheel plate 143 which is engaged to a lower side of each rotation pole 141, respectively, two rotation wheels 142 which are provided at both lower sides of the wheel plate 143, and a connection bar 144 which is welded to two rotation poles 141, respectively.

The fixing support leg 150 includes two fixing poles 151 which is bolt-engaged to the outer frame member of the backrest frame 130, a fixing horizontal bar 153 which is bent and extended from the upper side of each fixing pole 151, and a fixing wheel 152 which is disposed at a lower side of the fixing pole 151.

The conventional portable and foldable bed is capable of adjusting the angle of a backrest unit if necessary.

The conventional portable and foldable bed can be actually used by unfolding the bed frame 120 and the backrest frame 130 folded with respect to the center support bar 110.

However, the above conventional portable and foldable bed can be easily broken as the weight of the user may be concentrated on the rotation support leg 140 and the fixing support leg 150 when using the same.

In particular, since the engagement of the connection bar 144, which connects the rotation support leg 140 provided at both sides, is implemented by means of a welding method, the connected portion may be easily broken by the weight of the user.

In case of the fixing support leg 150, the fixing pole 151 vertically provided at both sides of the backrest frame 130 is engaged by means of only one engaging bolt due to the thickness of the backrest frame 130, so the fixing pole 151 can be easily bent and broken.

While the unfolded bed is being folded, since a folding force is not additionally applied, it is hard to fold the bed.

While the bed is being folded, since the fixing support leg 150 has a friction force with respect to the ground surface while contacting with the same, the folding work does not operate easily.

DISCLOSURE OF THE INVENTION

Accordingly, it is an object of the present invention to provide a portable and foldable bed which overcomes the conventional problems that the rotation support leg and the fixing support leg of the conventional portable and foldable bed are easily broken, and a lot of force is needed when folding the bed, and the fixing support leg generates a friction contact with the ground surface when folding the bed.

To achieve the above objects, there is provided a portable and foldable bed which comprises a triangle support plate at a corner of an engaged portion between a rotation pole of a rotation support leg and a connection bar, a fixing plate which has a width twice the width of a bed frame and is disposed in the bed frame engagement unit of the fixing support leg, a closer contact unit which is disposed between the fixing plate and the fixing support leg, and a foldable spring which is disposed between a lower horizontal bar of a center support bar and an outer frame of a bed frame.

EFFECTS OF THE INVENTION

In the present invention, it should be appreciated that a support strength of a rotation support leg is enhanced by installing a triangle support plate at an engaged portion between a rotation pole of a rotation support leg and a connection bar, and a fixing plate with a width twice the width of a bed frame is provided in a bed frame engagement unit of a fixing support leg, and a closer contact unit is provided between the fixing plate and the fixing support leg for thereby obtaining a stable engagement of the same, and a foldable spring is disposed between a lower horizontal bar of a center support par and an outer frame of a bed frame, so a folding operation can be easily performed during a folding operation of a bed.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

MODES FOR CARRYING OUT THE INVENTION

The embodiments of the present invention will be described with reference to the accompanying drawings.

In the portable and foldable bed according to the present invention, the strength of a rotation support leg and a fixing support leg can be enhanced, and the bed can be easily folded.

Figure 1:
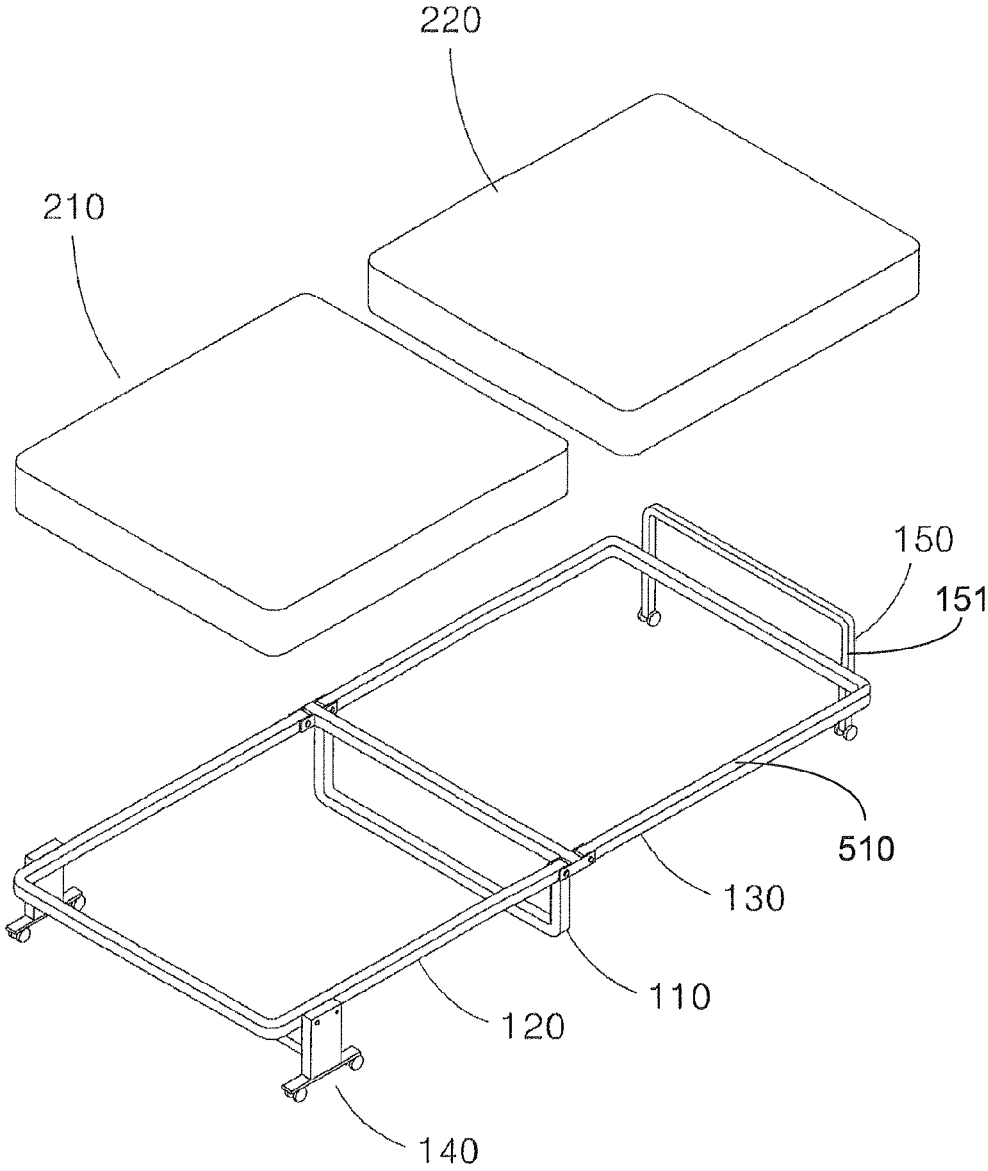
FIG. 1 (CONVENTIONAL ART)
FIG. 1 is a disassembled perspective view illustrating a conventional portable and foldable bed.
Figure 2:
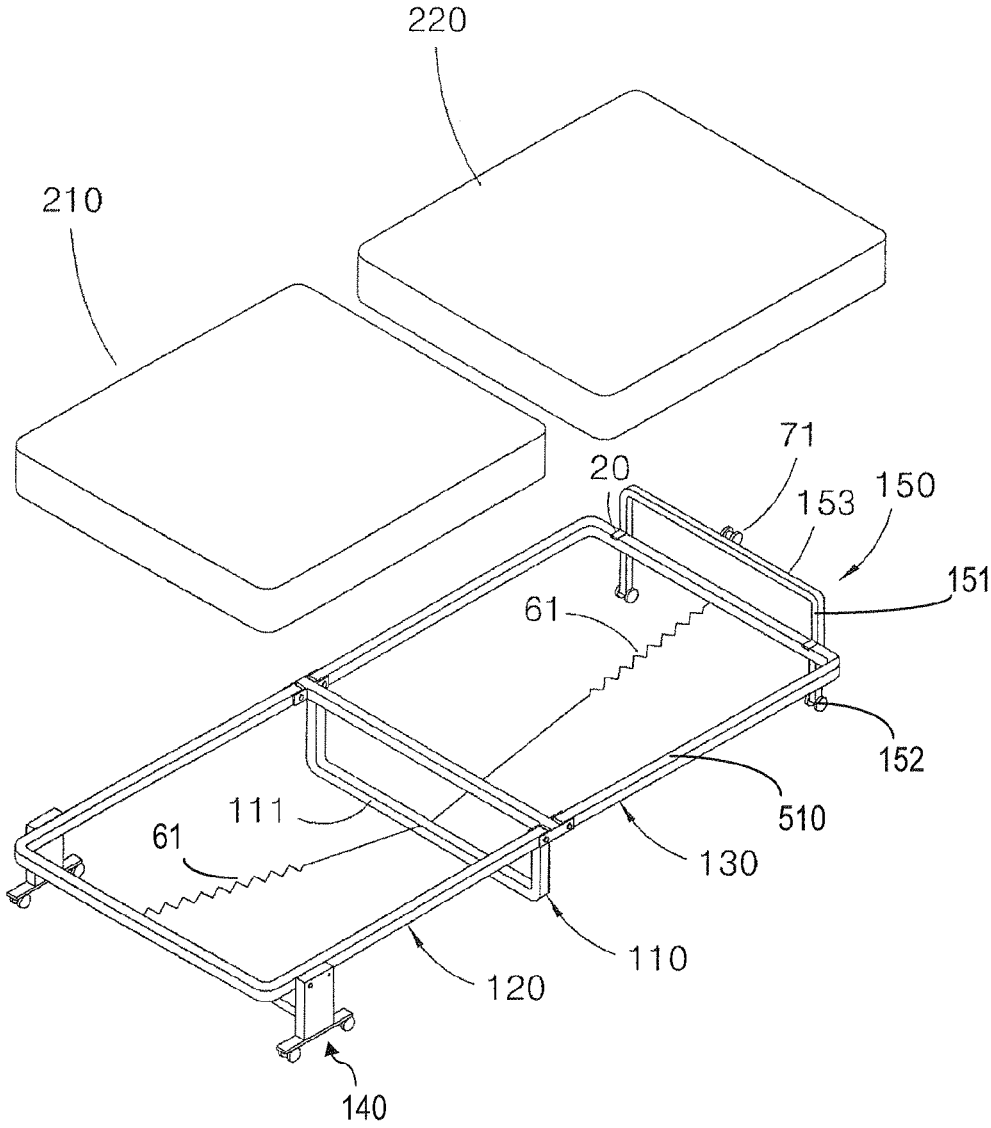
FIG. 2 is a disassembled perspective view illustrating a portable and foldable bed according to the present invention.
Figure 3:
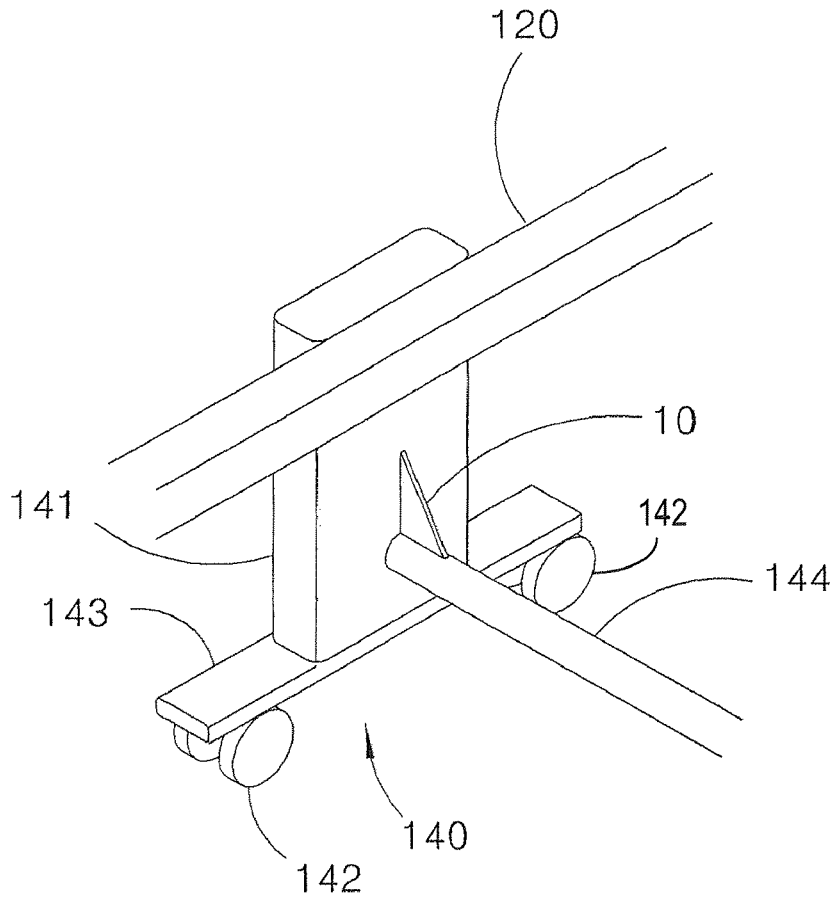
FIG. 3 is a detailed perspective view illustrating a rotation support leg according to the present invention.

As shown in FIG. 2, the portable and foldable bed comprises a bed frame 120 and a backrest frame 130 which are foldable from both sides with respect to a center support bar 110 which is formed by bending a rod in a rectangular shape, a bed unit 210 which is engaged to an upper side of the bed frame 120, a backrest unit 220 which is installed on an upper side 510 of the backrest frame 130, a rotation support leg 140 which is rotatably engaged to the bed frame 120, and a fixing support leg 150 which is engaged to an outer side of an outer frame member of the backrest frame 130, with the rotation support leg 140 including two rotation poles 141 which are engaged to a side frame member of the bed frame 120, a wheel plate 143 which is engaged to a lower side of each rotation pole 141, respectively, two rotation wheels 142 which are provided at both lower sides of the wheel plate 143, and a connection bar 144 which is welded to two rotation poles 141, respectively, and with the fixing support leg 150 including two fixing poles 151 which is bolt-engaged to the outer frame member of the backrest frame 130, a fixing horizontal bar 153 which is bent and extended from the upper side of each fixing pole 151, and a fixing wheel 152 which is disposed at a lower side of the fixing pole 151, As shown in FIG. 3, a triangle support plate 10 is welded at a corner of an engaged portion between a rotation pole 141 of the rotation support leg 140 and the connection bar 144.

Figure 4:
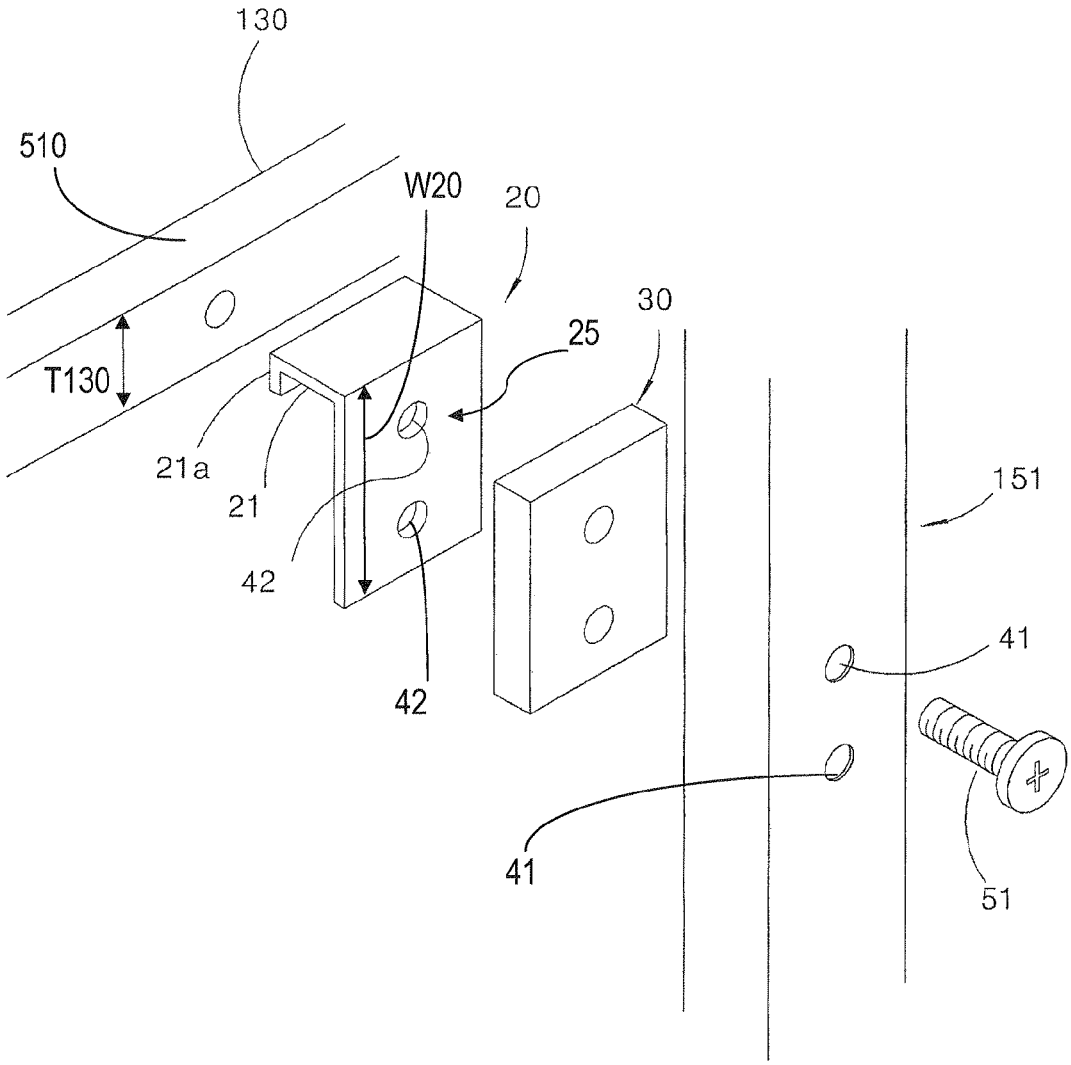
FIG. 4 is a disassembled perspective view illustrating the major elements of a fixing support leg according to the present invention.
Figure 5:
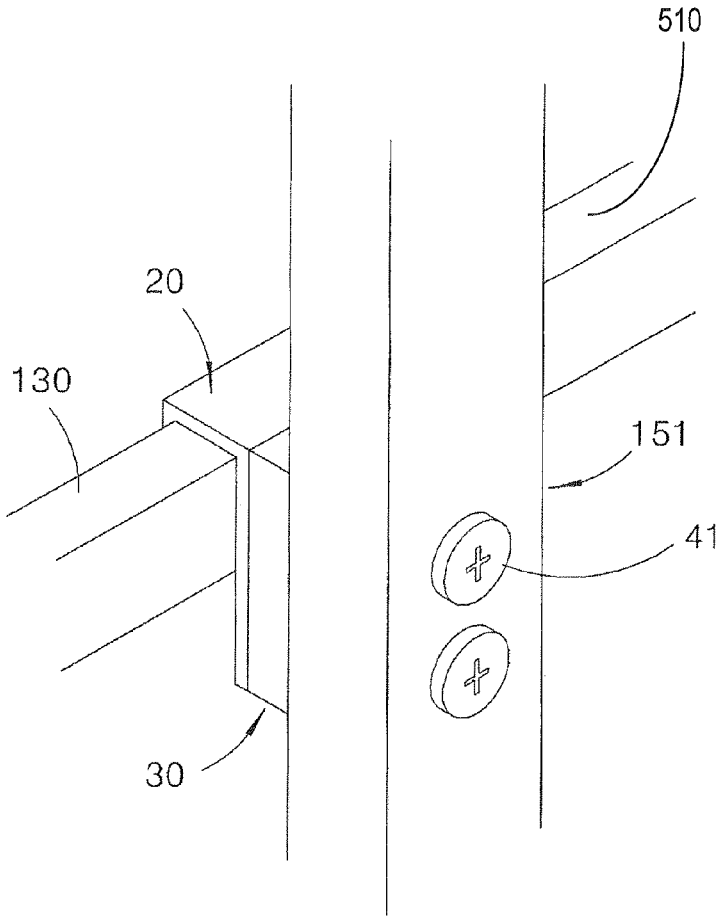
FIG. 5 is an engagement perspective view illustrating the major elements of a fixing support leg according to the present invention.

As shown in FIGS. 4 and 5, a fixing plate 20 is provided on an outer surface of the frame member of the outer side of the backrest frame 130 engaged to the fixing pole 151 of the fixing support leg 150 and has an upper and lower width W20 which is twice the thickness T130 of the frame member of the backrest frame 130, and a plate shaped closer contact unit 30 having a compressible performance like a synthetic resin is disposed between the fixing plate 20 and the fixing pole 151.

The fixing plate 20 includes one engaging unit 42 which passes through the frame member of the backrest frame 130, and another engaging unit 42 is disposed at its lower side, and two engaging holes 41 are formed in the fixing pole 151 of the fixing support leg 150 which corresponds thereto, so a reliable engagement is obtained by means two engaging bolts 51.

A horizontally bent handing unit 21 is formed on an upper side of the fixing plate 20 and is hanged by means of a frame member of the backrest frame 130, and the hanging part 21 includes an engaging shoulder 21*a* formed by bending its one end at a right angle for thereby being engaged by means of the frame member of the backrest frame 130.

Figure 6:
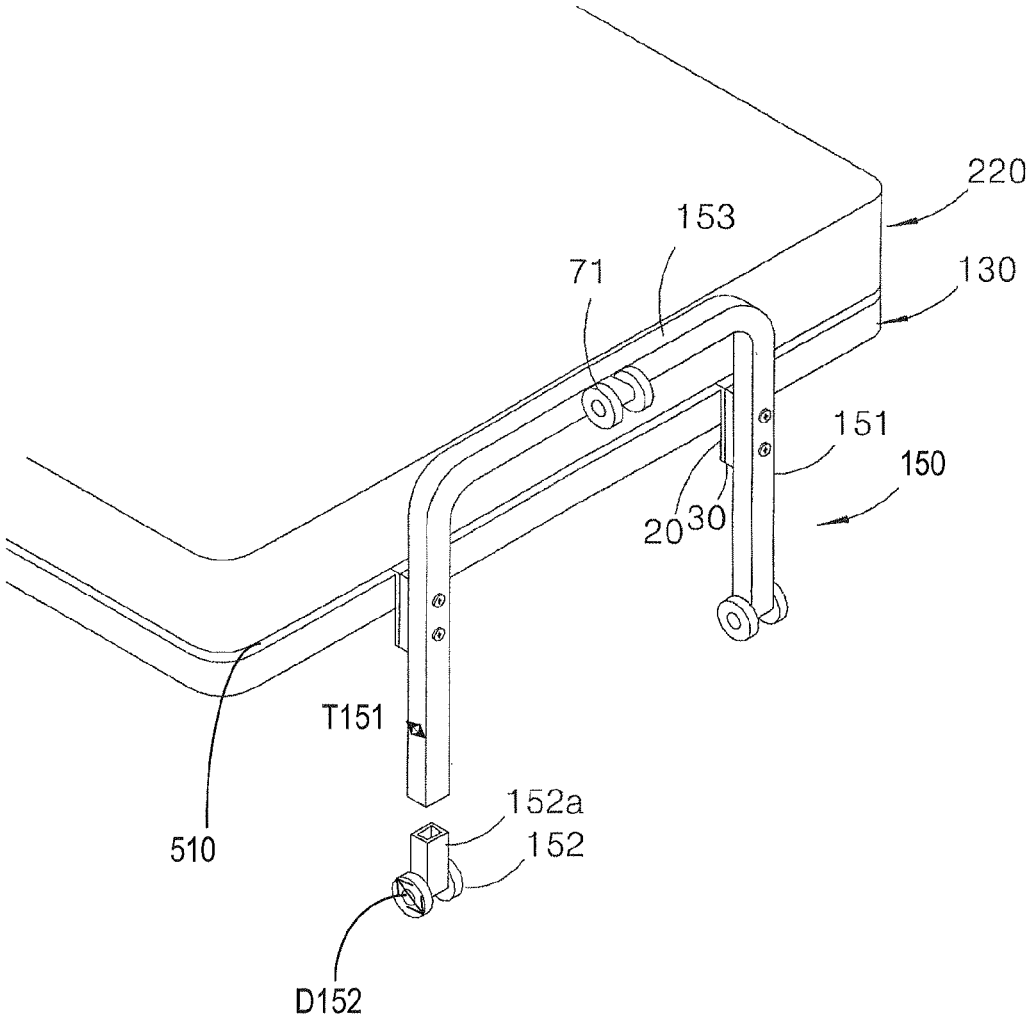
FIG. 6 is a perspective view illustrating a fixing support leg according to the present invention.
Figure 7:
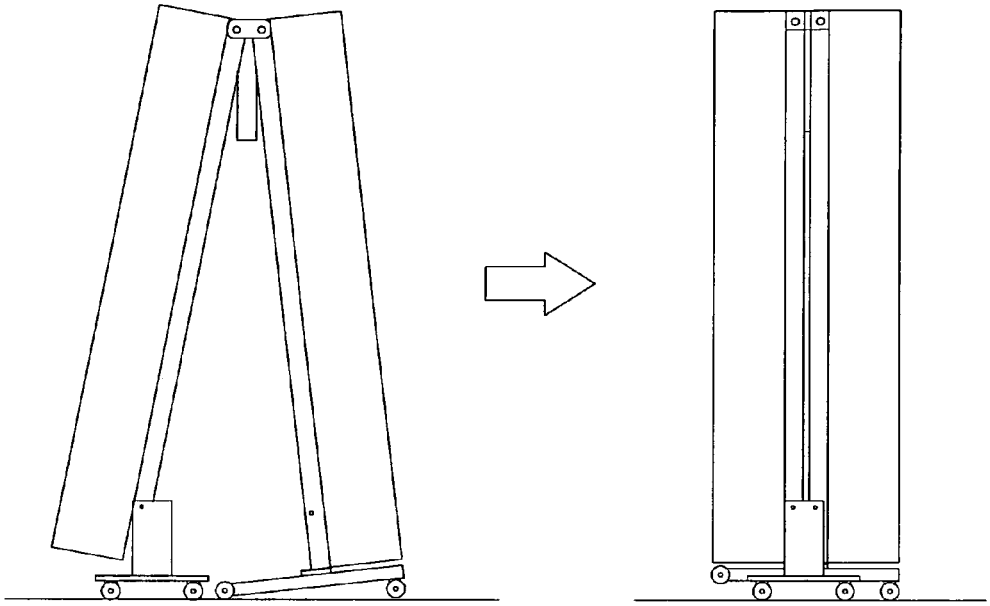
FIG. 7 is a view illustrating a folding operation of a foldable bed according to the present invention.

As shown in FIG. 6, the fixing wheel 152 disposed at a lower side of the fixing pole 151 of the fixing support leg 150 roll-contacts with the ground surface all the time while the bed is being folded, and has a diameter D152 larger than the thickness T151 of the fixing pole 151, and a fixing horizontal bar 153 includes a foldable wheel 71 which rolls on the ground surfaces when the folded bed moves while the bed is being folded or after the bed is folded.

As shown in FIG. 6, the fixing wheel 152 is provided with a wheel pole 152*a* for an easier manufacture, transportation and storage, so that it can be easily engaged to the fixing pole 151.

A foldable spring 61 is provided between the lower horizontal bar 111 of the center support bar 110 and the outer frame member of the bed frame 120, and between the lower horizontal bar 111 of the center support bar 110 and the outer frame member of the backrest frame 130, respectively, for thereby providing a folding force while the bed is being folded.

The operation of the present invention will be described with reference to the accompanying drawings.

In the portable and foldable bed according to the present invention, the triangle support plate 10 is welded at the corner of the engaged portion between the rotation pole 141 of the rotation support leg and the connection bar 144. During the use of the present invention, the engagement strength of the connection bar 144 and the rotation pole 141 is enhanced.

The fixing plate 20 is provided on an outer surface of the frame member of the outer side of the backrest frame 130 engaged with the fixing pole 151 of the fixing support leg 150, and the closer contact unit 30 is provided between the fixing plate 20 and the fixing pole 151. The fixing pole 151 bolt-engaged to the backrest frame 130 can be stably engaged, and it is possible to prevent a bending damage by means of the bolt engagement unit.

In addition, the fixing wheel 152 having a diameter larger than the thickness of the fixing pole 151 is provided in a lower side of the fixing pole 151 of the fixing support leg 150, and the foldable wheel 71 is provided in the fixing horizontal bar 153. With the above construction of the present invention, in a state that the fixing pole 152 keeps a continuous rolling contact with the ground surface, the foldable wheel 71 rolls on the ground surface for thereby implementing a reliable movement of the bed.

According to the present invention, the foldable spring 61 is disposed between the center support bar 110, the bed frame 120 and the backrest frame 130. With the above construction, an elastic folding force is applied between the bed frame 120 and the backrest frame 130 during the folding process of the bed.

As described above, it should be appreciated that the durability of the rotation support leg can be enhanced by providing the triangle support plate welded at the corner of the engaged portion between the rotation pole of the rotation support leg and the connection bar.

It should be appreciated that the fixing plate is provided in the backrest frame engaged to the fixing pole of the fixing support leg, and the closer contact unit is provided between the fixing plate and the fixing pole, so the engaging force and durability of the fixing pole can be significantly enhanced.

In addition, the fixing wheel having a diameter larger than the thickness of the fixing pole is provided in a lower side of the fixing pole of the fixing support leg, and the foldable wheel is provided in the fixing horizontal bar. With the above construction of the present invention, in a state that the fixing pole keeps a continuous rolling contact with the ground surface, the foldable wheel rolls on the ground surface for thereby implementing a reliable movement of the bed.

The foldable spring is disposed between the center support bar, the bed frame and the backrest frame. With the above construction, a folding work can be easily achieved with the help of the elastic force during the folding process of the bed.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A portable and foldable bed which includes a bed frame (120) and a backrest frame (130) which are foldable from both sides with respect to a center support bar (110) which is formed by bending a rod in a rectangular shape, a bed unit (210) which is engaged to an upper side of the bed frame (120), a backrest unit (220) which is installed on an upper side of the backrest frame (130), a rotation support leg (140) which is rotatably engaged to the bed frame (120), and a fixing support leg (150) which is engaged to an outer side of an outer frame member of the backrest frame (130), with said rotation support leg (140) including two rotation poles (141) which are engaged to a side frame member of the bed frame (120), a wheel plate (143) which is engaged to a lower side of each rotation pole (141), respectively, two rotation wheels (142) which are provided at both lower sides of the wheel plate (143), and a connection bar (144) which is welded to two rotation poles (141), respectively, and with said fixing support leg (150) including two fixing poles (151) which are bolt-engaged to the outer frame member of the backrest frame (130), a fixing horizontal bar (153) which is bent and extended from an upper side of each fixing pole (151), and a fixing wheel (152) which is disposed at a lower side of the fixing pole (151), comprising:

a triangle support plate (10) which is welded at a corner of an engaged portion between a rotation pole (141) of the rotation support leg (140) and the connection bar (144);

a fixing plate (20) which is provided on an outer surface of the frame member of the outer side of the backrest frame (130) engaged to the fixing pole (151) of the fixing support leg (150) and has an upper and lower width which is twice the thickness of the frame member of the backrest frame (130); and a plate shaped closer contact unit (30) which is disposed between the fixing plate (20) and the fixing pole (151), with said fixing plate (20) including one engaging unit (42) which passes through the frame member of the backrest frame (130), and with another engaging unit (42) being disposed at its lower side, and with two engaging holes (41) being formed in the fixing pole (151) of the fixing support leg (150) which corresponds thereto, so a reliable engagement is obtained by means two engaging bolts (51), wherein a horizontally bent handing unit (21) is formed on an upper side of the fixing plate (20) and is hanged by means of a frame member of the backrest frame (130), and said horizontally bent handing unit (21) includes an engaging shoulder (21*a*) formed by bending one end of said horizontally bent handing unit (21) at a right angle for thereby being engaged by means of the frame member of the backrest frame (130).

2. The bed of claim 1, wherein said fixing wheel (152) disposed at a lower side of the fixing pole (151) of the fixing support leg (150) roll-contacts with the ground surface all the time while the bed is being folded, and has a diameter larger than the thickness of the fixing pole (151), and a fixing horizontal bar (153) includes a foldable wheel (71) which rolls on the ground surfaces when the folded bed moves while the bed is being folded or after the bed is folded.

3. The bed of claim 1, wherein said fixing wheel (152) disposed at a lower side of the fixing pole (151) of the fixing support leg (150) roll-contacts with the ground surface all the time while the bed is being folded, and has a diameter larger than the thickness of the fixing pole (151), and a fixing horizontal bar (153) includes a foldable wheel (71) which rolls on the ground surfaces when the folded bed moves while the bed is being folded or after the bed is folded.

4. The bed of claim 1, wherein a foldable spring (61) is provided between a lower horizontal bar (111) of the center support bar (110) and the outer frame member of the bed frame (120), and between the lower horizontal bar (111) of the center support bar (110) and the outer frame member of the backrest frame (130), respectively, for thereby providing a folding force while the bed is being folded.

5. The bed of claim 1, wherein a foldable spring (61) is provided between a lower horizontal bar (111) of the center support bar (110) and the outer frame member of the bed frame (120), and between the lower horizontal bar (111) of the center support bar (110) and the outer frame member of the backrest frame (130), respectively, for thereby providing a folding force while the bed is being folded.

* * * * *